US007997828B2

(12) United States Patent
Rijlaarsdam

(10) Patent No.: US 7,997,828 B2
(45) Date of Patent: Aug. 16, 2011

(54) RETAINING WALL

(76) Inventor: Cornelis Elizabeth Rijlaarsdam, La Woubrugge (NL)

( * ) Notice: Subject to any disclaimer, the term of this patent is extended or adjusted under 35 U.S.C. 154(b) by 657 days.

(21) Appl. No.: 11/792,431

(22) PCT Filed: Dec. 6, 2005

(86) PCT No.: PCT/NL2005/000835

§ 371 (c)(1),
(2), (4) Date: Jan. 3, 2008

(87) PCT Pub. No.: WO2006/062393

PCT Pub. Date: Jun. 15, 2006

(65) Prior Publication Data

US 2009/0169306 A1 Jul. 2, 2009

(30) Foreign Application Priority Data

Dec. 6, 2004 (NL) ..... 1027665

(51) Int. Cl.
*E02B 7/40* (2006.01)
*E02B 7/54* (2006.01)

(52) U.S. Cl. ..... 405/114; 256/13; 405/110; 405/278; 405/284

(58) Field of Classification Search ..... 405/107, 405/110, 114, 284, 274–281; 256/13
See application file for complete search history.

(56) References Cited

U.S. PATENT DOCUMENTS

| | | | | | |
|---|---|---|---|---|---|
| 923,110 | A * | 5/1909 | Rafter | 405/278 |
| 933,665 | A * | 9/1909 | Boardman | 405/278 |
| 2,018,920 | A * | 10/1935 | Mette | 405/284 |
| 2,566,748 | A * | 9/1951 | Ringrose | 405/114 |
| 4,377,352 | A * | 3/1983 | Goodstein | 405/115 |
| 4,842,442 | A * | 6/1989 | Caulfield | 405/31 |
| 5,118,217 | A * | 6/1992 | Younes | 405/114 |
| 5,154,032 | A * | 10/1992 | Ritter | 52/592.1 |
| 5,178,490 | A * | 1/1993 | Snowberger et al. | 405/102 |
| 5,178,492 | A * | 1/1993 | Meheen | 405/284 |
| 5,199,812 | A * | 4/1993 | McClellan | 405/101 |
| 5,222,834 | A * | 6/1993 | Schultz | 405/94 |
| 5,584,601 | A * | 12/1996 | Hahn et al. | 405/30 |
| 5,758,989 | A * | 6/1998 | Snowberger | 405/80 |
| 6,132,140 | A * | 10/2000 | Kullberg | 405/114 |
| 6,196,764 | B1 * | 3/2001 | Bayssiguier | 405/102 |
| 6,450,733 | B1 * | 9/2002 | Krill et al. | 405/114 |
| 7,033,112 | B2 * | 4/2006 | Rijlaarsdam | 405/87 |
| 7,121,764 | B2 * | 10/2006 | Rorheim | 405/107 |
| 2003/0053864 | A1 * | 3/2003 | Rijlaarsdam | 405/107 |

FOREIGN PATENT DOCUMENTS

| | | |
|---|---|---|
| DE | 203 08 090 | 1/2004 |
| DE | 20 2004 011 003 | 11/2004 |
| WO | 97/04177 | 7/1996 |
| WO | 01/71099 | 9/2001 |

* cited by examiner

*Primary Examiner* — Tara Mayo-Pinnock
(74) *Attorney, Agent, or Firm* — Ladas & Parry LLP

(57) ABSTRACT

Retaining wall device, comprising at least one first retaining wall member (5) and a support (3, 4) for it, wherein the first retaining wall member and the support have first and second longitudinal edges, respectively, extending in longitudinal direction of the retaining wall, which longitudinal edges have been formed for connection to each other by a tilting or rotary motion about one or several axes that are parallel to the longitudinal edges, wherein the longitudinal edge that is opposite the first longitudinal edge (8) of the first retaining wall member is designed corresponding to the second longitudinal edge, wherein the first and second longitudinal edges can be provided with stop surfaces for limiting the tilting motion to mutual abutment of the first and second longitudinal edges in a retaining position of the first retaining wall member.

19 Claims, 9 Drawing Sheets

RETAINING WALL

BACKGROUND OF THE INVENTION

The invention relates to a retaining wall device, particularly for retaining water, which is adapted for from a condition of storage, in which no water retaining function is carried out, for instance folded up, is to be brought into an upright, retaining condition.

From International patent application WO01/71099 such a water retaining structure is known, which in one embodiment comprises a tray-shaped foundation for storage of the parts forming the retaining wall. The actual retaining wall comprises two or more retaining wall members connected to each other about longitudinal hinges, which retaining wall members in direction away from the water are rotated away one from the other until in an upright, retaining position. The lowermost retaining wall member is hinged to the foundation, at the longitudinal edge of the foundation situated at the barrier side. At the other longitudinal edge a shore plate is hinged the end edge of which can be clamped between both retaining wall members, in their upright position. The shore plate or one of the retaining wall member can be utilised as cover plate for the tray, and may optionally bear traffic load.

The retaining wall devices described and shown in International patent application WO01/71099 constitute a great improvement of the foldable structures intended for retaining incidentally occurring high water. In the design and manufacture of the retaining device intended for various barrier heights, due to the build of the structure use will have to be made, however, of retaining wall members of different panel widths, possibly each retaining height requiring its own related panel width. This results in a considerable number of parts of which the dimensions vary.

It is an object of the present application to provide a retaining wall device of the type mentioned in the preamble that is easy to adjust to the desired barrier height.

It is an object of the present application to provide a retaining wall device of the type mentioned in the preamble that can be erected quickly.

It is an object of the present application to provide a retaining wall device of the type mentioned in the preamble which despite having to be built up from parts to be assembled is able to offer a high strength.

It is an object of the present application to provide a retaining wall device of the type mentioned in the preamble which despite having to be built up from parts to be assembled may have a high degree of sealing properties.

BRIEF SUMMARY OF THE INVENTION

From one aspect the invention provides a retaining wall device, comprising at least one first retaining wall member and a support for it, wherein the first retaining wall member and the support have first and second longitudinal edges, respectively, extending in longitudinal direction of the retaining wall, which longitudinal edges have been formed for connection to each other by a tilting or rotary motion about one or several axes that are parallel to the longitudinal edges, wherein the longitudinal edge that is opposite the first longitudinal edge of the first retaining wall member is designed at least partially, corresponding to the second longitudinal edge for connection by the tilting or rotary motion.

Such a retaining wall device can be built up from individual retaining wall members, that can easily be stored, such as by stacking in situ, optionally in a (foundation) tray, or be kept ready at close distance, in which case a storage at the location of the retaining structure can remain limited, if necessary. As the first retaining wall members are provided at both longitudinal edges with the first and the second longitudinal edges, respectively, they can be used as modules, in which way design and delivery of retaining wall devices can easily be adjusted to the various barrier heights. Several first retaining wall members can be accommodated in the desired numbers in a tray-shaped foundation, and when erecting the retaining wall device be successively placed one above the other and then be connected to each other by the tilting motion. The placement of the retaining wall members can be carried out in a simple and controlled manner with the tilting motion, until the stop surfaces engage each other.

From a further aspect the invention provides a retaining wall device, comprising a number of first retaining wall members and a support for them, wherein the first retaining wall members have first and second longitudinal edges extending in longitudinal direction of the retaining wall, which longitudinal edges have been formed for connection to each other by a tilting or rotary motion about one or several axes that are parallel to the longitudinal edges, when connecting two first retaining wall members to each other.

In one embodiment the first and second longitudinal edges have been provided with stop surfaces for limiting the tilting motion to mutual abutment of the first and the second longitudinal edges in a retaining position of the first retaining wall member. The abutment action ensures mutual alignment of the retaining wall members and helps in keeping the retaining wall members in the retaining position.

In one embodiment, for enhancing the connection, the first and the second longitudinal edge have been formed with profilings, such as ribs and grooves, that are to be brought into inter-engagement with each other, On the first and the second longitudinal edge, the stop surfaces can be situated at the lee side of the profilings.

It is remarked that the first and second longitudinal edges and the profilings thereon need not necessarily be designed as continuous, uninterrupted. Of importance is that an engagement action is effected at several locations that are spaced apart in longitudinal direction.

If the second longitudinal edge is provided with a rib having a convex support surface and the first longitudinal edge is provided with a groove having a concave surface matching the convex surface, the tilting motion is facilitated and guided. During tilting the first retaining wall member is already supported by the support.

The second longitudinal edge can be provided with a groove and the first longitudinal edge with a rib fitting in the groove, wherein the groove and the rib may be are curved in the tilting direction, as a result of which a turn-in motion can be achieved and the connection is enhanced. In addition, on the first longitudinal edge the groove may be situated at the retaining side of the rib and on the second longitudinal edge the rib may be situated at the retaining side of the groove.

The support may comprise a first and a second support member, which are provided with a primary longitudinal edge and a secondary longitudinal edge, respectively, wherein the first and the second support member are detachably connectable to each other in order to form the second longitudinal edge with their primary and secondary longitudinal edges.

The profilings may be formed for locking the connection between the primary and secondary longitudinal edges when engaging into each other. The first longitudinal edge profilings thus prevent a release of both support members.

The primary longitudinal edge may be provided with the groove and the secondary longitudinal edge may be provided with a rib, which with the rib of the first longitudinal edge snugly fits into the groove of the primary longitudinal edge. At the lee side of the groove the primary longitudinal edge may then be provided with a rib and the secondary longitudinal edge may be provided with a groove fitting onto the rib.

For enhancing the sealing of the retaining wall device built up with the individual retaining wall member, at least one of the stop surfaces is provided with a sealing, such as a rubber sealing strip.

In a first embodiment the support comprises a second retaining wall member which is situated under the first retaining wall member when in the retaining position, which second retaining wall member has the second longitudinal edge. The second retaining wall member may itself be hinged, in one embodiment permanently, to a permanent foundation, such as known per se from International patent application WO01/71099. Alternatively the second retaining wall member can be connectable to a permanent foundation in a manner comparable to the connection between the first retaining wall member and the support.

In one embodiment including first and second support member, the first support member may form the second retaining wall member and the second support member a shore, which is hinged, in one embodiment permanently, to a permanent foundation. The optionally plate-shaped-shore can be connectable to a permanent foundation in a manner comparable to the connection between the first retaining wall member and the support.

In a second embodiment a permanent foundation is provided with the second longitudinal edge, in which case the first retaining wall member can be directly attached to a permanent base by tilting/turning in. For instance a house to be protected against high water may at a doorsill be provided with a second longitudinal edge on which the first retaining wall member can be arranged.

From a further aspect the invention provides a retaining wall device, comprising two retaining wall members that are situated adjacent to each other in longitudinal direction of the retaining wall device, wherein a sealing is placed at the location of the transition between both retaining wall members, wherein the retaining wall device is provided with an accommodation space for a coupling member for both retaining wall members, which coupling member can be placed in a coupling position connecting both retaining wall members to each other, wherein the coupling member also extends into a support member, while clamping the sealing against both retaining wall members.

In this way a firm and sealed connection can be quickly realised.

The support member may comprise a substantially upwardly extending shore, which is provided with a passage for the coupling member and is situated at the location of the transition of both retaining wall members. In that way the shore has an additional function as connection member. Advantageously the upwardly extending shore extends between both retaining wall members and is provided with the sealing, which also has another function.

Alternatively the support member forms a stationary structure, such as a wall of a house or permanent quay.

The accommodation spaces can be channel-shaped, wherein the coupling member is slidable in the accommodation spaces. Guidance is enhanced when the channels are tubular. For ease of placement of the coupling members the accommodation spaces are situated at the lee side of the retaining wall members. In case of strength improving channels (see below) they are shielded from the water.

For the retaining wall members that are situated at the end of the retaining wall and have to be connected to a further structure, a (manual) drive may be provided for moving the coupling member through the accommodation space from the opposite end of said retaining wall member until in an accommodation space in the permanent structure.

If the length of the coupling members is approximately the length of a retaining wall member, the coupling members may form a joined together series in a series of retaining wall members.

If the channel-shaped, particularly tubular accommodation spaces are attached to the retaining wall members, in one embodiment superposed, beyond the plate-shape thereof, they form a reinforcement of the retaining wall member.

Alternatively the accommodation space can be attached to a shore to be connected to both retaining wall members and extending in longitudinal direction of the retaining wall device. In the coupling position the coupling member can also clamp the shore to the first support member. In this way it is achieved that shore and two retaining wall members consecutive in longitudinal direction form as it were a rigid structure to be considered as one whole, as a result of which the design requirements can be met using less material.

A further advantage of the build-up described using coupling members for the shore and retaining wall members is that this structure is vandalism-proof, as no or hardly any screws, bolts etcetera are used and the coupling members are shielded.

In the embodiment with coupling members confined in the (tubular) accommodation spaces, the coupling members lock each other against sliding back, so that unauthorised disassembly of the retaining wall is not possible.

From a further aspect the invention provides a retaining wall device, particularly a retaining wall device as described in the previous parts of the description, comprising two retaining wall members situated adjacent to each other in longitudinal direction of the retaining wall device, wherein a vertical support is placed at the location of the transition between both retaining wall members against which support both retaining wall members support, furthermore provided with coupling members for connecting, in one embodiment with clamping action, both retaining wall members to each other and simultaneously to the support.

In one embodiment the support is provided with support surfaces facing the retaining wall members, wherein water sealings are provided between the retaining wall members and the support surfaces, in one embodiment attached to the support surfaces.

From a further aspect the invention provides a retaining wall device, comprising a foundation and at least one retaining wall member which with respect to the foundation can be brought into an upright, retaining position, wherein the retaining wall device furthermore comprises a first shore at the lee side of the retaining wall member, which first shore can be placed in a shore position supporting the retaining wall member in the retaining position in which the first shore extends parallel to its longitudinal direction, wherein the retaining wall device furthermore comprises at least a second shore at the lee side of the retaining wall member, which second shore can be placed in a shore position supporting the retaining wall member in the retaining position wherein the second shore extends transverse to its longitudinal direction. In that case there is question of two shore systems that complement each other in action without hindering each other.

The first shore may be substantially strip-shaped and provided with passages for the second shore.

The first shore can be hinged to the foundation, in one embodiment about an axis that is parallel to the longitudinal direction of the retaining wall member.

The second shore can be hinged to the foundation, in one embodiment about an axis that is transverse to the longitudinal direction of the retaining wall member.

In one embodiment the second shore supports several retaining wall members placed one above the other.

In addition to such a second shore, or alternatively, the second shore can be designed like an additional shore to be selectively placed while forming a support connection between an upper section of the retaining wall and the foundation. In that way the strength of the upper portion of the retaining wall that in accordance with design requirements extends above MHW, can be increased, as a result of which the retaining wall can also be retaining for unexpectedly higher water levels.

The second shore can be elongated and with a lower end be placed in the foundation and with the upper end be placed against the lee side of the retaining wall, in one embodiment with a resilient stop member against which the retaining wall can support.

From a further aspect the invention provides a retaining wall device, comprising a foundation and at least one retaining wall member which with respect to the foundation can be brought into an upright, retaining position, wherein the retaining wall device furthermore comprises a first shore and a second shore at the lee side of the retaining wall member for transferring barrier forces from the retaining wall member onto the foundation, wherein the first shore supports the retaining wall member according to a line that is parallel to the longitudinal direction of the retaining wall member, and the second shore supports the retaining wall member according to a line that is transverse to the longitudinal direction of the retaining wall member. The second shore can support several retaining wall members, such as the aforementioned first retaining wall members, that are placed one above the other.

The second shore may be situated at the location of the transition between two retaining wall members that are consecutive in longitudinal direction and be provided with a sealing for sealing the transition.

In this case as well the retaining wall device may furthermore comprise a coupling member for while clamping the sealing against both retaining wall members connecting the second shore and both retaining wall members to each other. Both retaining wall members and the second shore can be provided with passages for the coupling member that are to be aligned.

From another aspect the invention provides a retaining wall device comprising a foundation and a retaining wall member and/or a shore plate which is hinged to the foundation by means of a hinge, wherein the hinge is designed like a bending hinge, made of elastic material. Such a hinge can be made from synthetic material, such as TPE. Such a hinge is frostproof, rustproof and shock-absorbing and watertight.

The aspects and measures described and/or shown in the application may where possible also be used individually. Said individual aspects, such as the connection between retaining wall members situated one above one another, the connection between retaining wall members that are consecutive to each other in longitudinal direction, the connection of retaining wall members to a shore, the emergency shore, the hinge connections of cover/shore plate and/or lowermost retaining wall member to the foundation and other aspects may be the subject of divisional patent applications related thereto.

BRIEF DESCRIPTION OF THE DRAWINGS

The invention will be elucidated on the basis of a number of exemplary embodiments shown in the attached drawings, in which.

DETAILED DESCRIPTION OF THE INVENTION

Figure 1:
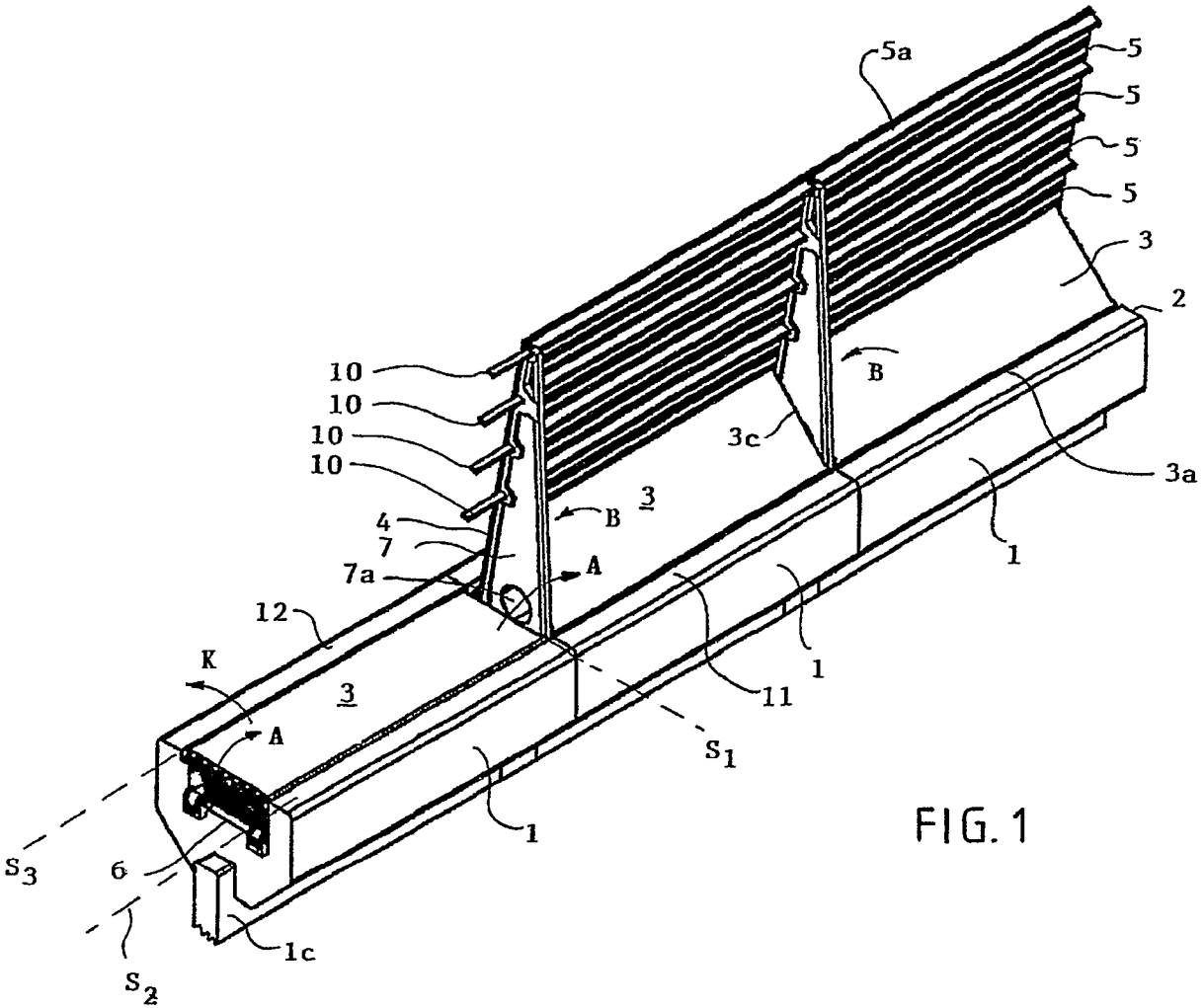
FIG. 1 shows an isometric view of a first exemplary embodiment of a retaining wall device according to the invention.
Figure 2:
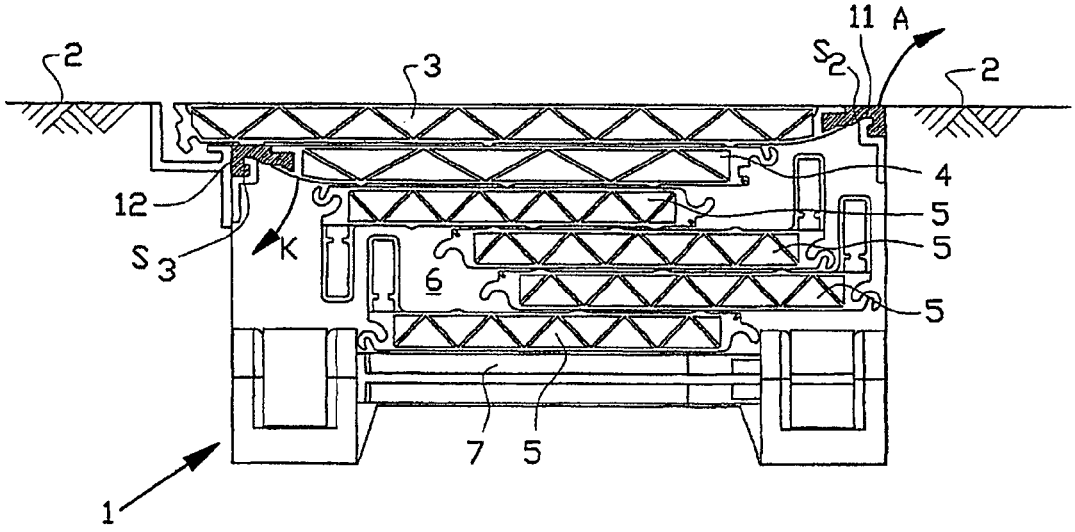
FIG. 2 shows a cross-section of a further exemplary embodiment of a retaining wall device according to the invention, in stored condition.

The retaining wall device 1 of FIG. 1 comprises a concrete accommodation channel 1 placed on a foundation plate 1*c* and offering room 6 for the accommodation of all necessary parts with which a retaining wall can be assembled, also see FIG. 2 to illustrate this.

The surface 2 may be a dike crown or the ground level in the public space, a quay wall near a river, channel or lake. The upper side of the accommodation channel 1 may be at ground level 2 yet may also project above ground level. The accommodation space 6 also serves as ventilating duct in order to limit formation of condensation wherein said space 1*a*, at the head and tail ends, may have ventilating ducts towards the open space.

At the lee side of the channel 1 shore plates 3 are hinged at the location of 11, for hinging motion A about S2 between an inoperative position, lying flat on the channel 1, and an inclined operative position, both shown in FIG. 1. At the barrier side the lowermost retaining wall members 4 are hinged at the location of 12, for hinging motion K about S3 between an inoperative position, lying flat in the channel 1, and an inclined operative position, shown in FIG. 1. The hinges 11 and 12 (also see FIG. 2) are designed like bending hinges, having a bending length, of elastic material. Such a hinge can be made from synthetic material, such as TPE, rubber, particularly fibre reinforced. Such a hinge is frostproof, rustproof, shock-absorbing and watertight.

The channel 1 furthermore offers room to intermediate shores 7, which are attached to the channel so as to hinge about horizontal line S1 that is transverse to the channel and which in direction B can be accommodated in the channel 1 by folding down.

Figure 1A:
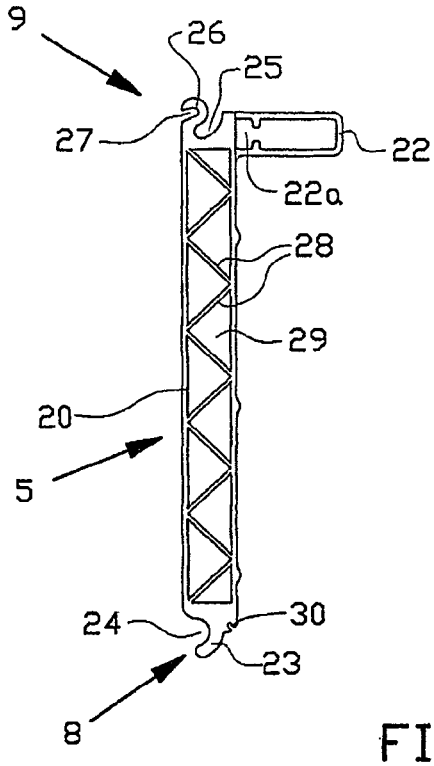
FIG. 1A shows an end view of a retaining wall member for the retaining wall device of FIG. 1.

The channel 1 further offers room to retaining wall members 5, further shown in FIG. 1A. The retaining wall members 5 like the retaining wall members 4 and shores 3 and 7 are made of aluminium, where possible as hollow elements. The retaining wall members may also be manufactured from another material such as fibre reinforced synthetic material or concrete.

The retaining wall members 4 and 5 are stacked in mutually coupled condition, and locked to the shores 7 by means of coupling rods or coupling beams 10. They form an inclined barrier surface for high water to be retained.

The channel 1 is in addition provided with sufficient room to have air moving in order to limit formation of condensation at the retaining wall members. In the transition seams between the channel parts or where necessary accommodated in the channel profile, discharge ducts may ensure the discharge of leakage water to land side.

The elongated, panel-shaped retaining wall member 5 of FIG. 1A has a barrier surface 20 and an opposite support wall 21. Between said walls 20, 21 reinforcement partitions 28 have been placed that define chambers 29.

At the first longitudinal edge 8 a lip is provided, which is curved towards the wall 20. The lip 23 defines a groove 24 in that way. At the lee side of the foot of the lip 23, a sealing 30 has been arranged. At the opposite second longitudinal edge 9 a groove 25 is provided, which as regards curvature is similar to the lip 23. At the barrier side of groove 25 a convex rib 26 has been formed, of which the upper surface has a curvature similar to the one of the concave bottom of the groove 24. The rib itself also forms a groove 27.

At the second longitudinal edge a tube 22 is furthermore integrally formed, in which coupling rods 10 can be accommodated and slidable with little play.

As shown in FIG. 2 several modular, identical retaining wall members can be accommodated in the space 6 of the channel 1. The stacking can be such that all wall members 3, 4 and 5 rest on top of each other, and via supports placed on the bottom of the channel, extending through the circular hole 7*a* (see FIG. 1) in the (down folded) shore 7, or in the vicinity thereof are able to transfer forces from the upper surface of the shore plate or cover plate 3 to the bottom of the channel, as a result of which it can be possible to bear traffic loads. When erecting the retaining wall the shore plate 3 can be rotated (A) upward about hinge 11 into a vertical intermediate position, and subsequently also the retaining wall member 4, about hinge 12 to a vertical intermediate position. After that the retaining wall members 5 can be taken out of the space 6, and subsequently the shores 7 can be rotated upwards between walls 3 and 4 to a vertical position, transverse to the channel direction.

While referring to FIGS. 4A-C the connection between shore plate 3 and retaining wall member 4 will be discussed. The upper edges of the retaining wall member 4 and the shore plate 3 together form a second longitudinal edge of which the configuration matches the first longitudinal edge 8 of wall member 5. This is realised by complementary design of both upper edges, wherein the upper edge of the shore plate 3 has a rib 35, which is able to turn (F) into groove 34 of the upper edge of retaining wall member 4. At the lee side of the rib 35 a groove 36 has been formed, in which a rib 38 on retaining wall 4 and provided with a sealing 37 can be fittingly accommodated.

Figure 4A:
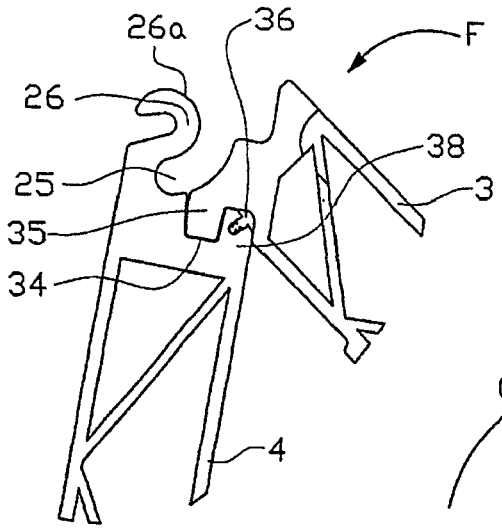
FIGS. 4A-C show three consecutive moments in coupling a shore to two retaining wall members.

Then the situation of FIG. 4A is achieved, in which a groove 25 has been formed. The channel 1 with shore plate 3 and retaining wall member 4 forms a rigid triangular tube.

The cover plates 3 in that case are between the upright shores 7, which in that case are each time confined and kept upright by two shore plates 3.

Figure 4B:
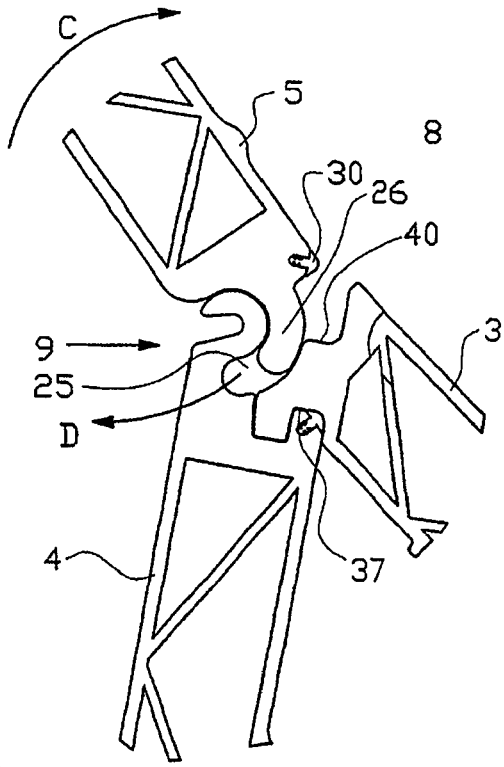
Figure 4C:
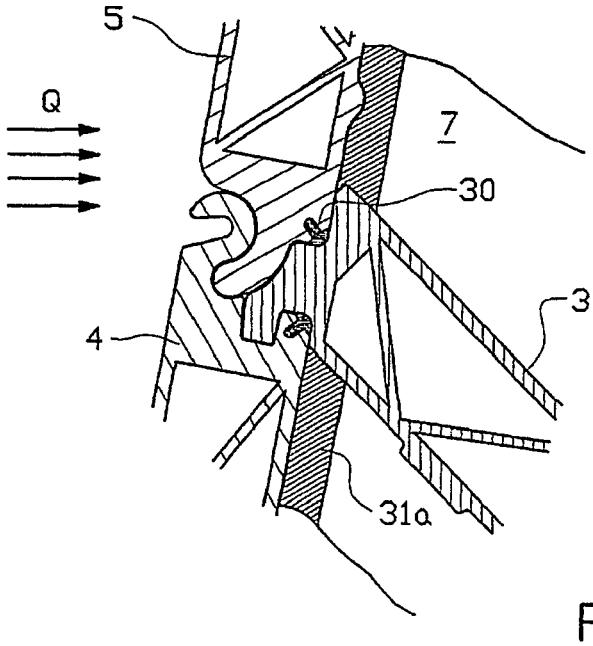
Figure 5:
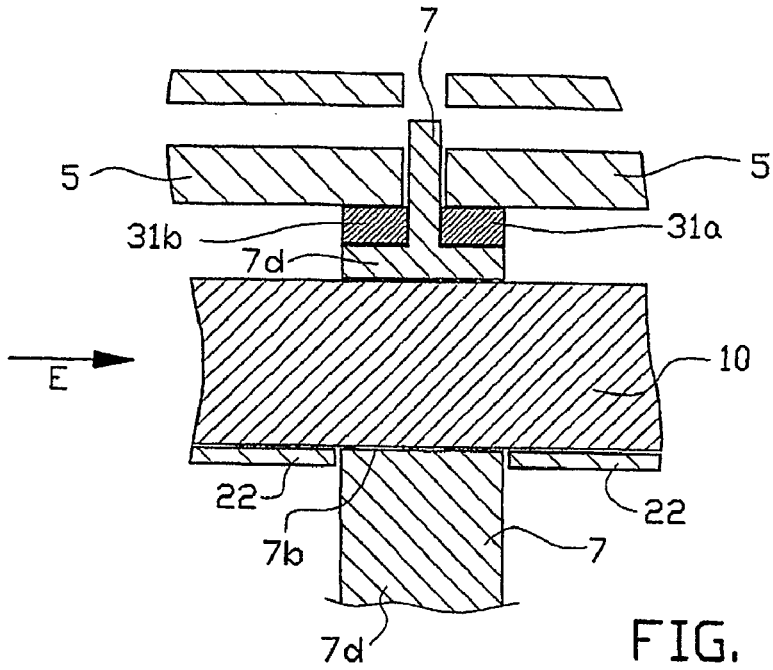
FIG. 5 shows a cross-section of a connection of an upright shore to two adjacent retaining wall members.

When raising the barrier height to above the retaining wall member 4 the first retaining wall member 5 with longitudinal edge 8 is brought at the upper edges of the shore plate 3 and retaining wall member 4, see FIG. 4B. The groove bottom 24*a* is superposed on rib 26, and subsequently the retaining wall member 5 is tilted upward, direction C, wherein the curved surface 24*a* rotates on curved surface 26*a*, in the form of a spherical bearing. In this way a type of hinge is obtained, as a result of which tilting can be carried out in a manageable and controlled manner, wherein the lip 23 rotates into the correspondingly curved groove 25. Finally the sealing 30 abuts the step 40 of the upper edge of the shore plate 3 and the lip 23 is fully accommodated in the groove 25, see FIG. 4C. The inter-engagement of both longitudinal edges prevents a further tilting beyond the position of FIG. 4C, in which both retaining wall members are in an (inclined) plane with each other. Furthermore the lip 26 secures the connection of shore plate 3 and retaining wall member 4.

Figure 3A:
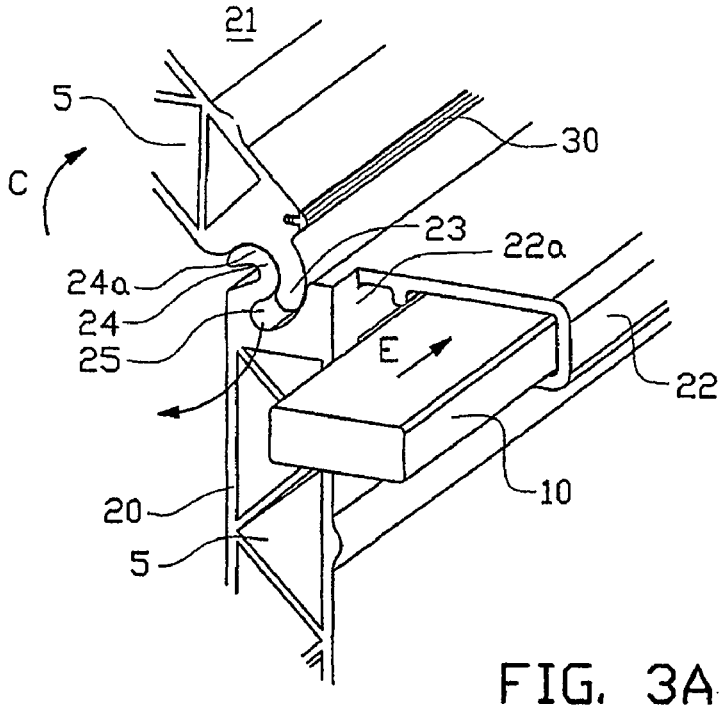
FIGS. 3A and 3B show two consecutive moments in coupling two retaining wall members situated one above the other.
Figure 3B:
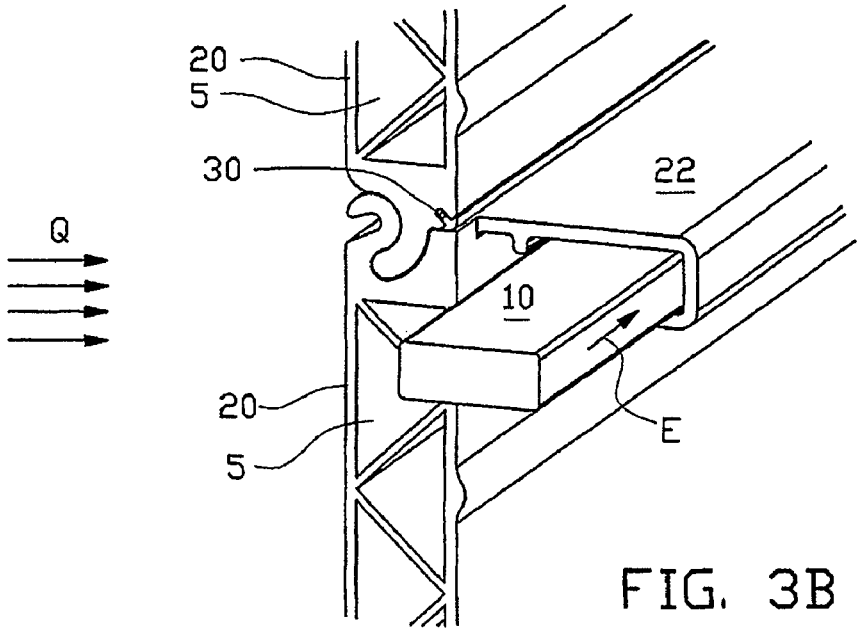

After that, if so desired, a next retaining wall member can be placed again and again in the height direction, wherein the same tilting/turning coupling motion is made, see FIGS. 3A and 3B. Uncoupling can only take place by the same motion in reverse direction.

The retaining wall members may further find support against the shores 7, which, on a thickened portion 7*d*, at their support edge facing the barrier side carry a sealing 31*a,b*, against which the inner surfaces of the retaining wall members 4, 5 may sealingly support. For enhancing the sealing and the connection use can be made of locking/coupling rods 10, which can be inserted in the direction E into the tubes 22, see FIGS. 3A,B and 5, which tubes extend over the full length of the retaining wall members 5.

With the coupling rods 10 two adjacently positioned retaining wall members are tightly connected to each other. From a free end of one of the retaining wall members to be connected to each other, a rod 10 is inserted into the tube 22, and with a stick or something like that brought into a temporary coupling with the end of the coupling rod is pushed forward until the centre of the rod 10 has arrived at the location of the joint, extending through a fitting hole 7*b* in the shore 7. A clamping force has then been generated. Then the stick etcetera is detached from the end of the coupling rod 10 and retracted. Due to the fit the rod 10 exerts a clamping force against the sealings 31*a,b* on the one hand and the inner wall of the tubes 22 on the other hand. As a result the joint between the retaining wall members is sealed against the shore 7.

The tube 22 extends beyond the wall 21 and forms a reinforcement of retaining wall member 5. Instead of the rod 10 a cable can be used which through an opening in shore 7 may effect a connection between panels 5 which are situated on both sides of shore 7.

At the ends of the retaining wall permanent walls or partitions can be provided with accommodation spaces for coupling rod 10 to be aligned with tubes.

Figure 6:
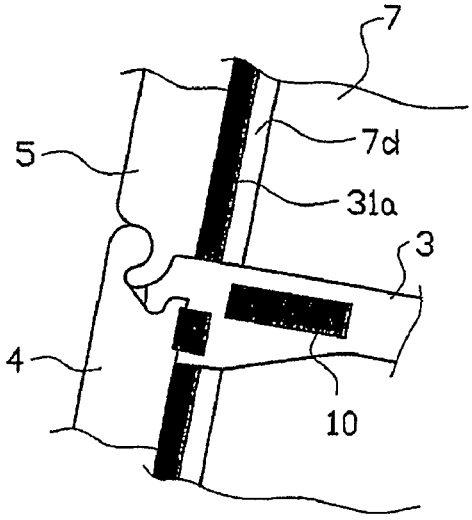
FIG. 6 shows a cross-section at the location of the connection shore plate/lowermost retaining wall member, to the coupling member.

It is remarked that, as shown in FIG. 6 the shore plate 3 below its upper surface may also be provided with a tube for a coupling rod. The tube may then optionally form a reinforcement of the shore plate 3, as a result of which it is stronger for bearing traffic loads.

Duct 22*a* offers room to the incoming or outgoing wiring of a circuit with which the barrier status of the retaining wall, by means of an automated signal operation can be checked. Said security function also applies as a soon as the retaining wall is stowed away in the channel 1 and a wiring of the circuit passes through the lock or closing profiles.

In the said manner at the location of the connections a clamping is obtained, without bolts or nuts, with sealing. In that case a structure is obtained that is a tightly tied to the channel 1, which structure in calculations can be included as one whole instead of as a collection of individual parts. This results in a more lightweight structure.

The joint between two adjacent shore plates 3 can also be used for an added emergency shore, which may give additional support to the shore 7 or may engage directly onto the retaining wall members. With the emergency shore the draft water retaining height can be increased.

Figure 7:
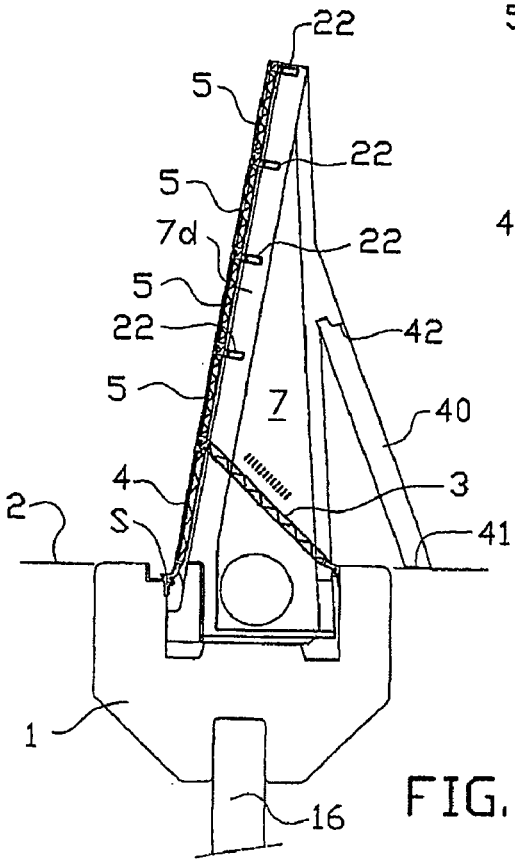
FIG. 7 shows an end view of a first example of a retaining wall device according to the invention including emergency shore.
Figure 8A:
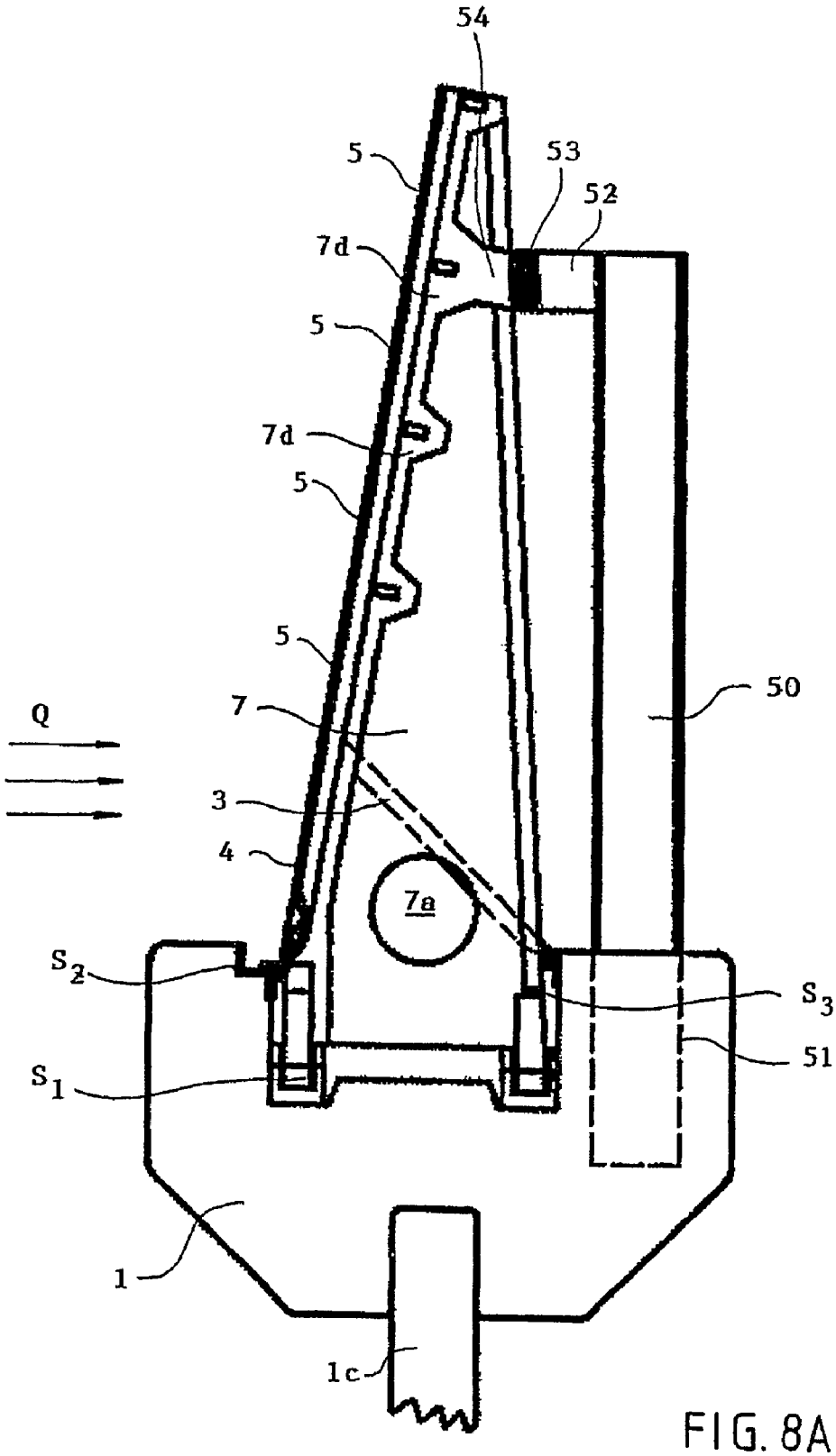
FIGS. 8A and 8B show an end view and an isometric view, respectively, of a second example of a retaining wall device according to the invention including emergency shore.
Figure 8B:
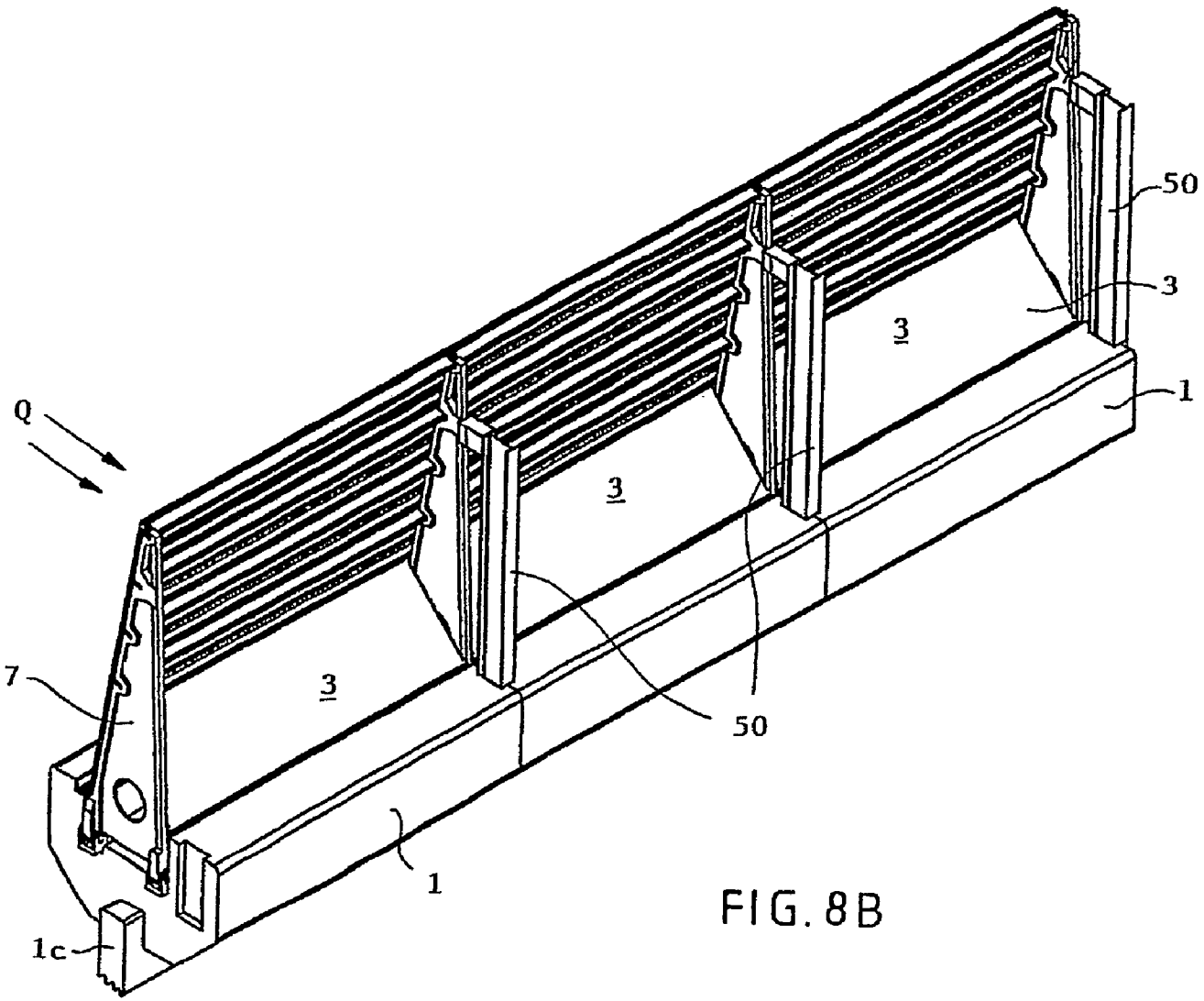

Alternatively an emergency shore may be added in the manner shown in FIG. 7 or 8A,B. In FIG. 7 an emergency shore 40 is placed with its lower end on the permanent bottom (at the location of a foundation that is not shown, which may form one unity with the channel 1) and with its upper end 42 supporting the shore 7. In the FIGS. 8A,B a column 50 having the shape of an I-profile or H-profile is placed in a hole 51 in channel 1. The upper end of the column 50 is turned at 52 and with a rubber buffer block 52 supports against thickened plate portion 7*d* of shore 7. The entire structure of the suggested retaining wall is now shock absorbing due to a cooperation between elements 3, 4, 5, 7 and 50.

When exerting large forces on the retaining wall a section, composed from retaining wall panels 5 and placed between the shores 7, cannot be pushed out of the retaining wall, although possibly deformed, be kept in a retaining function by the locking coupling rods 10 in the tubes 22.

The joints between the shore plates 3 can in the stowed away position be closed off by closing profiles (not shown). Said closing profiles can be engaged by lock profiles that are placed parallel to the upper edge of the cover or shore plate 3, at choice per retaining wall section. As soon as a closing profile is broken open in an unauthorised manner a signal is obtained which makes raising alarm possible.

It is remarked that it is also possible to hinge the retaining wall member 4 and/or the shore plate 3 to the channel 1 by means of a tiltable, turnable, detachable connection. In order to let the shores 7 pass to their upright position an upright position that is turned further should indeed be achievable. The connection between both upper edges can then be in accordance with FIGS. 4A-C.

Figure 9A:
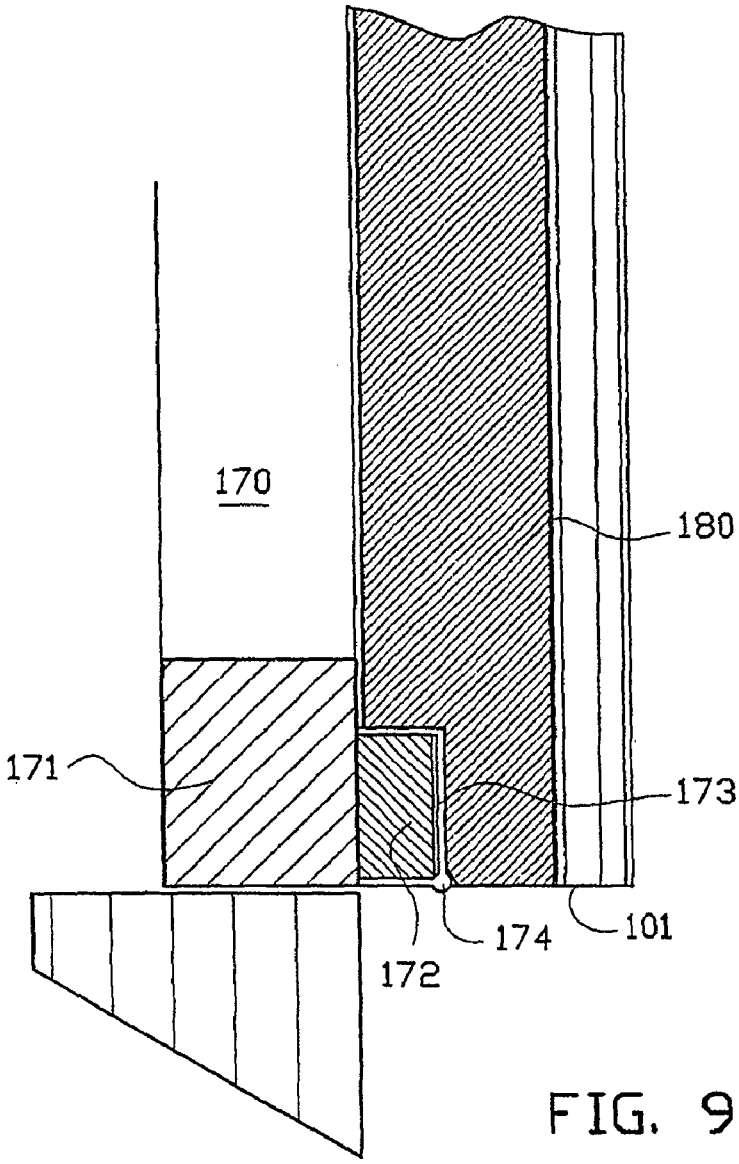
FIGS. 9A and 9B show a top view and a cross-section, respectively, of an exemplary embodiment of a retaining wall device according to the invention for protecting a passage in a house.
Figure 9B:
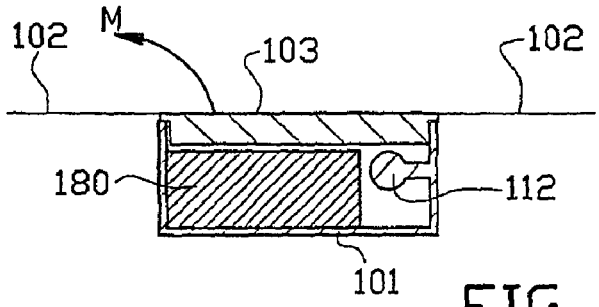
Figure 10A:
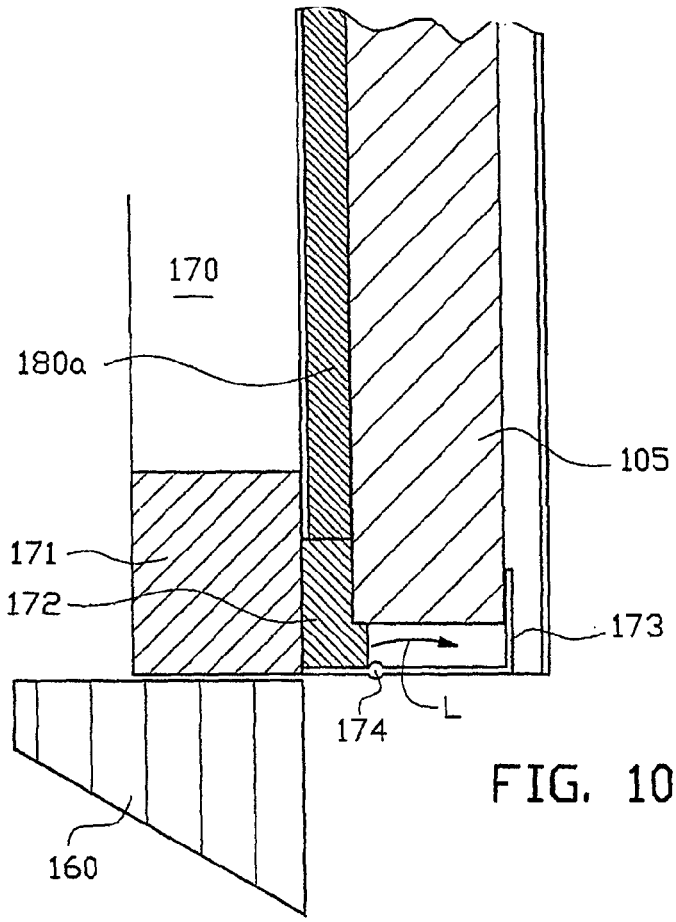
FIGS. 10A-C show a top view, a cross-section and a front view, respectively, of the exemplary embodiment of FIG. 9A,B in condition of use.
Figure 10B:
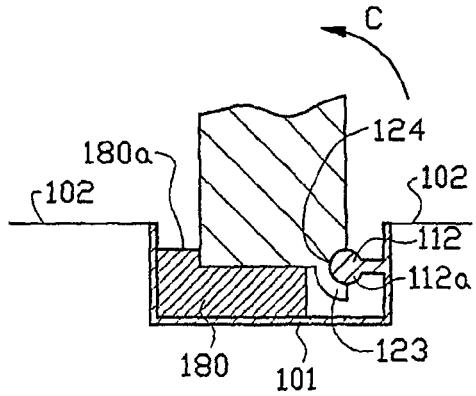
Figure 10C:
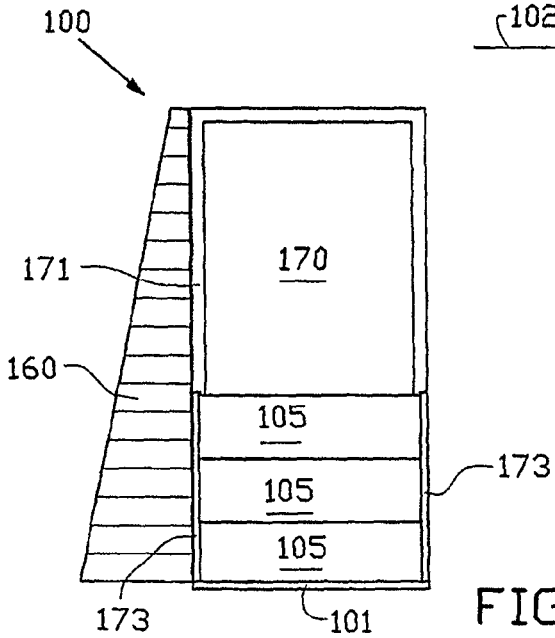

In FIGS. 9A,B and 10A-C an example is given of a straight retaining wall, supported against a permanent wall, such as a wall of a house 100 (FIG. 10C). The house 100 is provided with a wall 160 and has a door 170, limited by a casing 171. It may regard a dike house here, having the door 171 at crown level. Below the sill a tray 101 is placed, in which a rubber sealing and support strip 180 is placed. The tray 101 is provided with a hinge 112 at the wall situated at the other barrier side and above it is covered by a cover plate 103 that is removable in direction M. As can be seen in FIG. 9A the casing is covered by a rubber sealing strip 172. Said strip is accommodated in a case a frame 173 of which is hinging about hinge 174 from a closed position to one or more open positions, one of which is shown in FIG. 10A. The frame 173 may be divided in vertical direction.

If there is danger of the water rising above the crown, the cover plate 103 is removed and the cases of the sealing strips 172 are opened. The frames 173, as can be seen in FIG. 10A, form an accommodation space for retaining wall members 105. At their lower edge the retaining wall members 105 are provided with a groove 124, which fits on hinge 112, and at their upper edge they are provided with a rib complementary to it, so that here as well a connection by tilting can be realised. The lowermost retaining wall member 105 is placed inclined on the hinge 112, and then tilted in the direction C towards a vertical position, supporting against the sealings 172. The frame 173 present at said level is for that purpose rotated slightly further than is indicated. After placement of said retaining wall member 105 the frame 173 can be rotated back, to the position shown in FIG. 10A. After that further retaining wall members 105 are one by one placed one on the other in a comparable manner. The lower edge and upper edge of the retaining wall members 105 may in one embodiment be similarly shaped to the edges 8 and 9 of retaining wall members 5. When all desired retaining wall members 105 have been stacked and all frames 173 have been rotated about their axes 174 to the position of FIG. 10A, and optionally have been locked in said position, the retaining wall is confined in all directions in a shock-absorbing manner.

The invention claimed is:

1. A water retaining wall device, comprising at least a first retaining wall member and a support for supporting the first retaining wall member, wherein the first retaining wall member has a first longitudinal edge and the support has a second longitudinal edge, the first and second longitudinal edges extend in a longitudinal direction of the retaining wall and are shaped for connection to each other by a rotary motion about one or several axes that are parallel to the first and second longitudinal edges, wherein the first retaining wall member has a further longitudinal edge that is opposite to the first longitudinal edge and is shaped for connection to the first longitudinal edge of a further retaining wall member by the rotary motion, wherein the support comprises a second retaining wall member which is situated under the first retaining wall member when in the retaining position, and wherein the second longitudinal edge is provided on the second retaining wall member.

2. A retaining wall device according to claim 1, wherein the first and second longitudinal edges are provided with stop surfaces for limiting the rotary motion to mutual abutment of the first and second longitudinal edges in a retaining position of the first retaining wall member.

3. A retaining wall device according to claim 2, wherein at least one of the stop surfaces is provided with a sealing.

4. A retaining wall device according to claim 2, wherein both stop surfaces are provided with a sealing, wherein the sealings are adjacent to each other.

5. A retaining wall device according to claim 1, wherein the first and the second longitudinal edge are formed with inter-engaging profiles that are to be brought into inter-engagement with each other.

6. A retaining wall device according to claim 5, wherein on the first and the second longitudinal edge the stop surfaces are situated at a lee side of the profiles.

7. A retaining wall device according to claim 5, wherein the second longitudinal edge is provided with a rib having a convex support surface and the first longitudinal edge is provided with a groove having a concave surface matching the convex surface.

8. A retaining wall device according to claim 5, wherein the second longitudinal edge is provided with a groove and the first longitudinal edge is provided with a rib fitting in the groove.

9. A retaining wall device according to claim 1, wherein the second retaining wall member is hinged to a permanent foundation.

10. A retaining wall device according to claim 1, wherein a permanent foundation is provided with the second longitudinal edge.

11. A water retaining wall device comprising at least a first retaining wall member and a support for supporting the first retaining wall member, wherein the first retaining wall member has a first longitudinal edge and the support has a second longitudinal edge, the first and second longitudinal edges extend in a longitudinal direction of the retaining wall and are shaped for connection to each other by a rotary motion about one or several axes that are parallel to the first and second longitudinal edges, wherein the first retaining wall member has a further longitudinal edge that is opposite to the first longitudinal edge and is shaped for connection to the first longitudinal edge of a further retaining wall member by the rotary motion, wherein the support comprises a first and a second support member, which are provided with a primary longitudinal edge and a secondary longitudinal edge, respectively, wherein the first and the second support member are detachably connectable to each other in order to form the second longitudinal edge with their primary and secondary longitudinal edges.

12. A retaining wall device according to claim 11, wherein the first and the second longitudinal edge are formed with inter-engaging profiles that are to be brought into inter-engagement with each other and wherein the profiles are formed for locking the connection between the primary and secondary longitudinal edges when engaging into each other.

13. A retaining wall device according to claim 12, wherein the second longitudinal edge is provided with a rib having a convex support surface and the first longitudinal edge is provided with a groove having a concave surface matching the convex surface and wherein the primary longitudinal edge is provided with the groove and the secondary longitudinal edge is provided with a further rib, with which the rib of the first longitudinal edge fits into the groove of the primary longitudinal edge.

14. A retaining wall device according to claim 13, wherein at a lee side of the groove the primary longitudinal edge is provided with a rib and the secondary longitudinal edge is provided with a groove fitting onto the rib.

15. A water retaining wall device comprising at least a first retaining wall member and a support for supporting the first retaining wall member, wherein the first retaining wall member has a first longitudinal edge and the support has a second longitudinal edge, the first and second longitudinal edges extend in a longitudinal direction of the retaining wall and are shaped for connection to each other by a rotary motion about one or several axes that are parallel to the first and second longitudinal edges, wherein the first retaining wall member has a further longitudinal edge that is opposite to the first longitudinal edge and is shaped for connection to the first longitudinal edge of a further retaining wall member by the rotary motion, wherein the support comprises a first and a second support member, which are provided with a primary longitudinal edge and a secondary longitudinal edge, respectively, wherein the first and the second support member are detachably connectable to each other in order to form the second longitudinal edge of the support member with the primary and secondary longitudinal edges of the first and second support members, and wherein the first support member forms a second retaining wall member and the second support member form a shore.

16. A retaining wall device according to claim 15, wherein the second support member is hinged to a permanent foundation.

17. A retaining wall device according to claim 16, wherein the second support member is connectable to a permanent foundation in a manner comparable to the connection between the first retaining wall member and the support.

18. A retaining wall device according to claim 15, wherein the second support member is plate-shaped.

19. A retaining wall device comprising two retaining wall members, a sealing and a coupling member, wherein the two retaining wall members are situated adjacent to each other in a longitudinal direction of the retaining wall device, wherein the sealing is placed at the location of the transition between the two retaining wall members, wherein the retaining wall device is provided with an accommodation space for the coupling member for the two retaining wall members, which coupling member can be placed in a coupling position connecting the two retaining wall members to each other, wherein the coupling member also extends into a support member, while clamping the sealing against the two retaining wall members in the coupling position.

* * * * *